US007158651B2

(12) United States Patent
Bachmann et al.

(10) Patent No.: US 7,158,651 B2
(45) Date of Patent: Jan. 2, 2007

(54) ELECTROMAGNETIC DRIVER FOR A PLANAR DIAPHRAGM LOUDSPEAKER

(75) Inventors: Wolfgang Bachmann, Grevenbroich (DE); Hans-Jürgen Regl, Regensburg (DE); Gerhard Krump, Schwarzach (DE); Andreas Ziganki, Mettmann (DE)

(73) Assignee: Harman/Becker Automotive Systems GmbH, Straubing (DE)

( * ) Notice: Subject to any disclaimer, the term of this patent is extended or adjusted under 35 U.S.C. 154(b) by 650 days.

(21) Appl. No.: 10/432,487

(22) PCT Filed: Sep. 26, 2001

(86) PCT No.: PCT/EP01/11184

§ 371 (c)(1),
(2), (4) Date: May 21, 2003

(87) PCT Pub. No.: WO02/43435

PCT Pub. Date: May 30, 2002

(65) Prior Publication Data

US 2004/0028254 A1 Feb. 12, 2004

(30) Foreign Application Priority Data

Nov. 23, 2000 (DE) ..... 100 58 104

(51) Int. Cl.
*H04R 25/00* (2006.01)

(52) U.S. Cl. ..... 381/412; 381/191; 381/396; 381/421; 381/431

(58) Field of Classification Search ..... 381/191, 381/396, 410, 412, 421, 431, 423
See application file for complete search history.

(56) References Cited

U.S. PATENT DOCUMENTS

| | | | | |
|---|---|---|---|---|
| 4,090,041 | A | 5/1978 | Mori et al. | |
| 4,392,027 | A | 7/1983 | Bock | |
| 4,680,492 | A | 7/1987 | Tamura | |
| 4,928,312 | A | 5/1990 | Hill | |
| 5,539,835 | A | 7/1996 | Bertagni et al. | |
| 5,638,456 | A | 6/1997 | Conley et al. | |
| 5,991,423 | A * | 11/1999 | Norte | 381/396 |
| 6,347,149 | B1 | 2/2002 | Bachmann et al. | |

FOREIGN PATENT DOCUMENTS

| | | |
|---|---|---|
| DE | 19757097 | 6/1999 |
| DE | 19821860 | 11/1999 |
| EP | 0774880 | 5/1997 |

(Continued)

*Primary Examiner*—Curtis Kuntz
*Assistant Examiner*—Tuan Duc Nguyen
(74) *Attorney, Agent, or Firm*—Alfred A. Fressola; Ware, Fressola, Van Der Sluys & Adolphson, LLP

(57) ABSTRACT

The invention relates to an electromagnetic driver comprising a soft magnetic core in the form of an E with three legs and a back, an alternating field driver, magnetically coupled to the soft magnetic core, for generating an alternating magnetic field in the soft magnetic core, depending upon a sound signal, a constant field driver magnetically coupled to the soft magnetic core for generation of a constant magnetic field in the soft magnetic core, a soft magnetic element for coupling to the plate of the planar diaphragm loudspeaker, lying opposite the back and magnetically closing the legs across at least one small induction gap, whereby the constant field and the alternating field are asymmetrically superimposed such that a resulting force, or a resulting torque on the soft magnetic element, is proportional to the sound signal.

20 Claims, 3 Drawing Sheets

FOREIGN PATENT DOCUMENTS

| | | |
|---|---|---|
| WO | 9514363 | 5/1995 |
| WO | 9709842 | 3/1997 |
| WO | 9717818 | 5/1997 |

* cited by examiner

ELECTROMAGNETIC DRIVER FOR A PLANAR DIAPHRAGM LOUDSPEAKER

CROSS REFERENCE TO RELEATED APPLICATIONS

This application is for entry into the U.S. national phase under §371 for International Application No. PCT/EP01/11184 having an international filing date of Sep. 26, 2001, and from which priority is claimed under all applicable sections of Title 35 of the United States Code including, but not limited to, Sections 120, 363 and 365(c), and which in turn claims priority under 35 USC §119 to German Patent Application No. DE 100 58 104.8 filed on Nov. 23, 2000.

TECHNICAL FIELD

The invention concerns an electromagnetic driver for a planar diaphragm loudspeaker.

BACKGROUND OF THE INVENTION

Electromagnetic transducers are known in general for example from WO 95/14363 or in particular with linearization of the characteristic curve by inserting a permanent magnet, for example from EP O 774 880 or from U.S. Pat. No. 4,680,492. Such transducers are primarily used as signal generators or door buzzers. It is a characteristic of these applications that the nonlinearity of the power line current curve either causes no disturbance (e.g. due to heavy damping of the harmonics) or that the nonlinearity becomes tolerable due to premagnetization and minor control.

Diaphragm loudspeakers in a planar configuration are known as piston radiators, for example from U.S. Pat. Nos. 5,539,835 or 4,928,312, or in the multiresonance configuration as bending wave radiators for example from WO 97/09842 or DE 197 57 097, and in addition to the sturdy, rigid plate (diaphragm) with a holder they comprise a drive system (e.g. one or several drivers) which provide excitation power to the plate at one or several points.

Beyond that WO 97/17818 or U.S. Pat. No. 5,638,456 propose for example piezoelectric drivers which, although they are very sturdy, in practice are always too weak for large plates.

Even though electrodynamic drives develop sufficient power and deflection, they have however a setting problem in connection with the plate coupling. The usual sandwich plates made of different types of bonded materials are very light and unbending, but do not keep their shape over time. Particularly the layers of adhesive used to produce the sandwich plates change their consistency. Constant gravity for example produces a certain creep and flow direction. Beyond that thermal stresses during operation lead to local softening with irreversible shape changes. This in turn causes the coil which is attached to the plate to shift from its original position.

Each relative misalignment between the coil directly attached to the plate and the magnet system that is attached farther away creates displacement components which tilt the coil's axis from its normal position or shift the coil into an eccentric position. This can cause the voice coil to touch the walls of the annular gap in the magnet system and thereby render the drive unusable.

The operation of bending wave radiators has the further problem in which the usual drivers perform an undesirable pumping movement, because bending without "pumping" is desirable in bending wave radiators, as opposed to piston radiators.

Furthermore the drivers named so far do not permit any edge excitation during bending wave operation. But this excitation position is necessary when using transparent plates, or plates on which both sides are used as an image field. Even though the electrodynamic drivers known for example from U.S. Pat. No. 4,392,027 or DE 198 21 860, which exert power normal to the plate surface, can be cost-effectively produced, they have the disadvantage of a relatively large construction depth and need a relatively large surface for support by an external bead. Furthermore it is precisely the edge area of the plate which creates a problem for the long-term stable adjustment of the voice coil position with respect to the external bead.

SUMMARY OF THE INVENTION

It is the object of the invention to present a driver for a planar diaphragm loudspeaker which is less sensitive with respect to settings.

Among other things an advantage of the invention is that the (axial) coil height can be kept very small, whereby a minimum thickness of the planar diaphragm loudspeaker can be achieved.

This is accomplished with an electromagnetic driver for a planar diaphragm loudspeaker, which comprises a soft magnetic core in the shape of an E with three legs and a back, and an alternating field exciter which is magnetically (and particularly securely) coupled to the soft magnetic core for generating therein a magnetic alternating flux that depends on a sound signal. In addition a constant field exciter is magnetically coupled to the soft magnetic core for generating a constant magnetic flux in the soft magnetic core, and a soft magnetic element (e.g. a chip, magnetic diaphragm, yoke, etc.) is installed opposite the back to magnetically terminate the legs across at least one small induction gap, where the alternating flux and the constant flux are asymmetrically superimposed so that depending on the shape, a resulting force or a resulting torque in the soft magnetic element is essentially linear with respect to the sound signal.

Thus one essential measure of the invention comprises the use of the known electromagnetic transducing principle in which the driving coil is motionless. Here however the magnetic force is proportional to the square of the magnetic induction and thus to the square of a sound signal current flowing through the driving coil. On the other hand the unavoidable settings can be much better tolerated without a voice coil and a vibration gap with narrow tolerances.

Another measure provides for premagnetization (for example with additional direct current or with permanent magnets), which however is not used to linearize the characteristic curve as is usually the case. Linearization means here shifting the working point from zero to a parabolic load, so that a small modulation can cause the parabola to act approximately as a tangent.

A third measure comprises the design of a preferably symmetrical magnetic circle with an asymmetrical field distribution. For example a magnetic field vector produced by a driving coil is superimposed in the soft magnetic outer circle by a constant field vector produced for example by a permanent magnet from the central leg, so that an addition takes place in one outer leg and a subtraction in the other outer leg. Despite the quadratic power line current curve of a single magnetized leg and depending on the shape, the force or the torque act in strictly linear form to the sonic frequency induction, and thus to the sound signal itself.

A further development of the invention provides a yoke as the soft magnetic element, which is able to pivot on the free end of the soft magnetic core's central leg, and has induction gaps at least with respect to the two other legs, so that the yoke which is driven by the alternating field exciter produces a corresponding torque. The formation of a torque in the yoke which acts as a bidirectional lever compensates the nonlinear components of the outer leg forces so that the resulting torque from a symmetrical construction is strictly proportional to the sonic frequency induction, and thus to the electrical sound signal itself. Here the yoke terminates the open ends of the E-core with small induction gaps (e.g. an air gap or a resilient nonmagnetic material). The yoke is supported by the central leg of E-shaped core on which it is able to pivot, so that the system is excited to sonic frequency by the coil and produces a sonic frequency torque in the pivoting yoke, and its inverse torque is formed by the rotational moment of inertia of the E-shaped core (inertial torque driver).

It can furthermore be provided that the alternating field exciter is a coil located on one of the two outer legs and controlled by the sound signal, and the direct field producer is a permanent magnet located in the central leg of the soft magnetic core. This achieves an asymmetrical superimposition of the alternating flux and the direct flux without any great expense.

Instead of a permanent magnet, a coil through which a direct current flows can also be used as the direct field producer where, depending on the arrangement of the permanent magnet, the coil can be located on the central leg of the soft magnetic core. The advantage of a coil through which a direct current flows is that the sound volume radiated by the planar diaphragm loudspeaker can be changed by changing the force of the direct current.

The yoke is preferably held in a rest position by two nonmagnetic spring elements located in the induction gaps between the outer legs and the yoke. This makes a rotational movement possible, where instead of air the spring elements use a different nonmagnetic material to fill the induction gap or gaps. This allows the driver to be attached to the plate without any outside support, only with the soft magnetic element (e.g. the yoke). Instead of or in addition to the spring elements, the back of the E-shaped soft magnetic core can also be attached by a bridge (beam, crossbar, etc.) to a frame of the planar diaphragm loudspeaker to improve its low frequency sensitivity.

Furthermore a nonmagnetic bearing can be provided to install the yoke on the central leg of the soft magnetic core, so that in fact an induction gap also results between the soft magnetic element and the central leg. In view of the mechanical properties, a defined bearing on the central leg is an advantage over a solution without such a bearing, since this can definitely prevent shearing or pumping movements, compared to a holder containing only the above cited spring elements.

Instead of an inertial torque loudspeaker, the invention can also provide a single pole planar diaphragm loudspeaker, wherein two soft magnetic cores each have an E-shaped form with a back and three legs, which are secured back-to-back, and two alternating field exciters each of which is magnetically coupled to one of the soft magnetic cores for generating therein a magnetic alternating flux that depends on a sound signal. Such a driver additionally comprises two constant field exciters, each of which is magnetically coupled to one of the soft magnetic cores, for generating a constant magnetic flux in the respective soft magnetic core, as well as two soft magnetic elements placed opposite the respective back to magnetically terminate the corresponding legs with at least one small induction gap for coupling to the plates of the planar diaphragm loudspeaker, where the alternating flux and the constant flux are again asymmetrically superimposed so that a resulting torque in the respective soft magnetic element is essentially linear with respect to the sound signal.

The polarity of the alternating field exciters is chosen so that the alternating flows in the backs of the E-cores do not flow in the opposite but in the correct direction. In that case the torques being emitted to the outside receive their opposite torque from the other respective E-core, to prevent the entire driving arrangement from experiencing any rotational acceleration under the same external load (preferably by aligning the same type of front and back plate), thus forming a torque driver for single pole planar diaphragm loudspeakers.

As an alternative to two soft magnetic E-shaped cores arranged back-to-back, a one-piece soft magnetic core with a total of six legs can also be used; it comprises two partial E-shapes which are secured back-to-back. Both the one-piece core made of two partial E-shapes and the driver composed of two individual E-shaped cores can be built and developed in the same manner as the single E-shaped core.

Another development of the invention has a soft magnetic core in an E-shape comprising three legs and a back located at the edge of the planar diaphragm loudspeaker's plate, where the outer legs are bent like clamps toward the plate, and the plate is located on the opposite side of the back. In addition an alternating field exciter is magnetically coupled to the soft magnetic core, for generating therein an alternating magnetic flux that depends on a sound signal, as well as a constant field exciter which is magnetically coupled to the soft magnetic core and is arranged on the plate in the area of the open ends of the legs, for generating a constant magnetic flux, where the alternating flux and the constant flux are asymmetrically superimposed so that a resulting force in the constant field exciter is proportional to the sound signal. This makes it possible to excite the plate from the edge, so that either transparent plates or plates which are optically useable on both sides can be used.

The preferred alternating field exciter in such a driver is a coil which is controlled by the sound signal and is located on the central leg, and a permanent magnet is the constant field exciter, where the outer legs detect a constant magnetic flux from the permanent magnet flowing parallel to the normal plate direction, and an alternating flux emitted from the central leg, so that the alternating flux and the constant flux are added in one of the outer legs and subtracted in the other outer leg.

Nonmagnetic spring elements are preferred as holders between the outer legs and the plate, whereby the clamplike legs grasp the plate and are articulated at the edge. This provides an additional suspension for the plate at the lowest cost.

The constant flux of the constant field exciter(s) in all drivers can also be adjustable so that the sound volume of the planar diaphragm loudspeaker can be changed.

Finally an electromagnetic driver according to the invention is arranged so that the forces it produces impact the edge area of the plate, where the width of that edge area is approximately equal to the plate thickness.

BRIEF DESCRIPTION OF THE DRAWINGS

The invention is explained in greater detail in the following by means of the embodiments illustrated in the figures of the drawings, where elements having the same effect receive the same reference signs.

DETAILED DESCRIPTION

Figure 1:
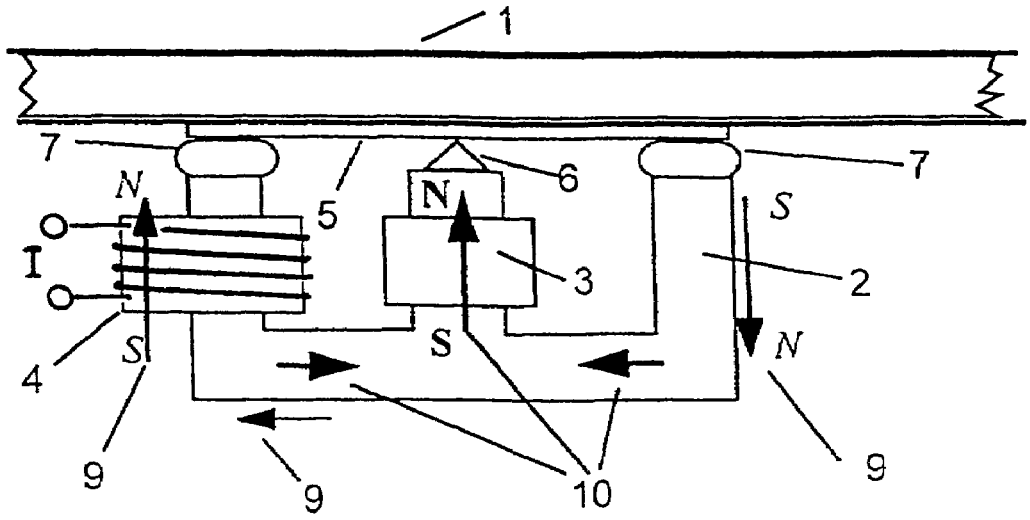
FIG. 1 is a first embodiment of a driver according to the invention for use in a planar diaphragm loudspeaker.

FIG. 1 shows an electromagnetic inertial torque driver according to the invention which is coupled to a sandwich diaphragm 1 resulting in a multiresonance planar diaphragm loudspeaker. A soft magnetic E-shaped pole core 2 (made of ferrite material for example) with two outer legs and a central leg is an alternating field exciter equipped with a motionless driver coil 4 on one of the outer legs. It is also possible to install a driver coil on each of the outer legs and have the same current flowing through it. In the embodiment of FIG. 1 the premagnetization takes place in the central leg by means of a constant field exciter, such as for example a coil having direct current flowing though it, or by a permanent magnet 3. The direction of the respective constant field vector 10 is oriented toward the central leg, where the polarity (N-S or S-N) is arbitrary. A sonic frequency alternating current I flows through the driver coil 4 and generates an alternating field vector 9. This fluctuating sonic frequency alternating field vector 9 is added to the constant field vector 10 in one outer leg, but is however subtracted from the constant field vector 10 in the other outer leg.

A soft magnetic yoke 5 closes a magnetic circle which extends across the soft magnetic pole core 2. The yoke 5 is able to pivot on the central leg. The rocker bearing 6 can be designed as a knife edge as shown in FIG. 1, but it can also be realized in any other suitable manner. In this case it is important that the existing unidirectional forces from both outer legs receive a virtually incompressible support from the bearing 6, but that any tilt movements in which the bearing 6 is the pivot point are exposed to a comparably small resistance.

The force $F_L(t)$ over time t in one leg then is:

$$F_L(t)=\beta\cdot B_L^2(t)$$

and the force $F_R(t)$ in the other leg now is:

$$F_R(t)=\beta\cdot B_R^2(t),$$

where the force difference $\Delta F(t)$ then becomes:

$$\Delta F(t)=\beta(B_R^2-B_L^2)=4\beta B_T B_O$$

where $B_L=B_T(t)+B_O$ $B_R=B_T(t)-B_O$ $B_T(t)=\alpha\cdot I(t)$

Here $B_L$ represents the magnetic flux in the first outer leg, $B_R$ is the magnetic flux in the second outer leg, $B_T(t)$ is the alternating flux generated by the alternating field exciter, $B_O$ is the constant flux generated by the constant field exciter, I(t) is the time-dependent sonic frequency excitation current and $\alpha$, $\beta$ are transducer constants.

As can be seen, in spite of the quadratic power line current curve of a single magnetized leg, the force difference at the ends of the yoke 5 acting as a two-sided lever, thus the torque, is strictly linear with respect to the sonic frequency induction and therefore to the sound signal itself.

Nonmagnetic spring elements 7 are inserted so that they connect each of the outer legs with the yoke 5, to mechanically stabilize the driver structure and especially the definition of a mechanical resting point. In the arrangement shown in FIG. 1, the reaction torque to the sonic frequency tilt vibration is derived exclusively from the rotational inertia of the entire arrangement. An alternative in this case could be a bridge construction (gantry) that also connects the back of the driver with a plate holder.

Starting with the driver shown in FIG. 1, a single pole multiresonance planar diaphragm loudspeaker can simply be created with one or several internal electromagnetic single pole torque drivers.

Figure 2:
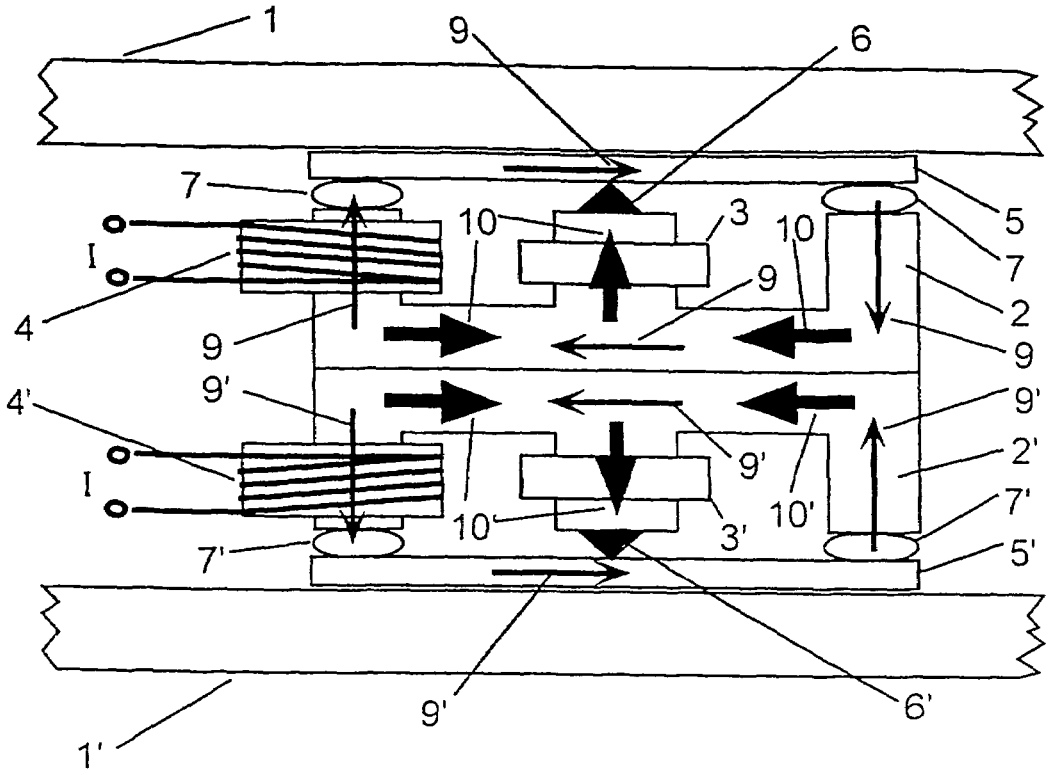
FIG. 2 is a second embodiment of a driver according to the invention for use with a single pole planar diaphragm loudspeaker.

FIG. 2 is a section of a single pole multiresonance planar diaphragm loudspeaker with a front 1 and a rear 1' sandwich plate. The two plates 1, 1' are connected by means of one (or several) single pole torque drivers. A single pole torque driver is created by arranging two equal inertial torque drivers back-to-back as shown with the embodiment of FIG. 1. For a more efficient production and/or to reduce the constructed depth, the back-to-back mounting can be accomplished with a one-piece core having the corresponding shape.

The example of a single pole torque driver in FIG. 2 shows two inertial torque drivers according to FIG. 1 that are coupled back-to-back with each other and to two sandwich diaphragms 1, 1' on the opposite side of the back. Two E-shaped soft magnetic pole cores 2, 2' (made of ferrite material for example), each having two outer legs and one central leg, therefore have one motionless driver coil 4, 4' installed as an alternating field exciter on each of the outer legs. Premagnetization is provided in the respective central leg by a constant field exciter, such as for example a coil through which direct current flows, or by a permanent magnet 3, 3'. The associated constant field vector 10, 10' is oriented in the direction of the central leg, where the polarity (N-S or S-N) is arbitrary. A sonic frequency alternating current I flows through the driver coil 4, 4' and thereby generates an alternating field vector 9, 9'. This fluctuating sonic frequency alternating field vector 9, 9' is added to the constant field vector 10, 10' in one outer leg, but is however subtracted from the constant field vector 10, 10' in the other leg.

The advantage of the electromagnetic single pole torque driver is that it does not depend on the inertial force as a reaction torque. Accordingly the mass of the fixed driver coils 4, 4' can be significantly reduced. The same sonic frequency current must flow through the two driver coils 4, 4', where the coil wiring must be designed so that the driving torques compensate each other in the back-to-back connection. Another advantage of a single pole planar diaphragm loudspeaker is the reduction of the acoustic dipole short circuit.

Figure 3:
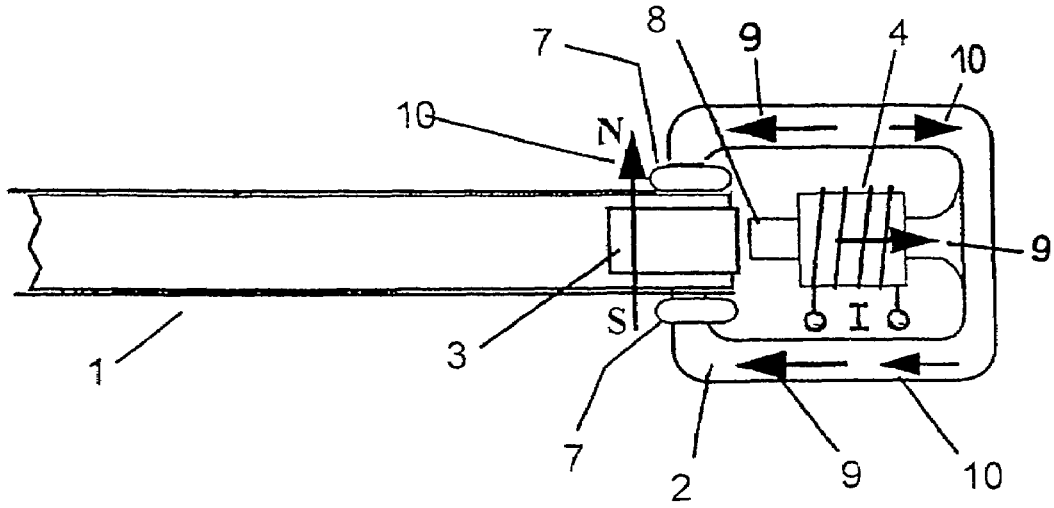
FIG. 3 is a third embodiment of a driver according to the invention to be mounted on the edge of the planar diaphragm loudspeaker.

FIG. 3 shows a cross section of the edge of a plate 1 in a planar diaphragm loudspeaker and a clamp-shaped electromagnetic edge driver in the working position. The plate 1 is a sandwich construction, but any other design is also possible. A continuous or a partially interrupted surrounding pad usually provides an articulated bearing for the plate 1, particularly in a multiresonance operation. This articulated pad in turn is supported by the surrounding frame. In the driver shown in FIG. 3 a spring element 7 takes over the role of the articulated bearing. An E-shaped soft magnetic pole core 2 is bent like a clamp and is supported by a frame not illustrated in any detail.

In contrast to the magnet systems shown in FIGS. 1 and 2, the driver in FIG. 3 generates a driver flux 9 in a central leg 8, which originates from a coil 4. A light weight permanent magnet 3 (for example a rare-earth magnet such as neodymium) is inserted into the plate edge, or is cemented in the form of two thin wafers on each surface of the edge area (not illustrated in the drawing). It generates the permanent flux (constant field vector 10). In this arrangement the flux between the central leg and each of the outer legs results from the sum or the difference of the individual flows (10, 19). This causes the resulting difference in the forces from the two legs bent like a clamp, which act on the permanent magnets 3 inserted into the plate 1, to be again proportional to the coil current despite the quadratic curve.

Finally drivers according to the invention can drive a single plate or a front and a rear plate by themselves or in addition to other drivers, where this is preferably a single plate with a light, unbending, overhanging sandwich diaphragm. A frame can also support the one or both plates.

Figure 4:
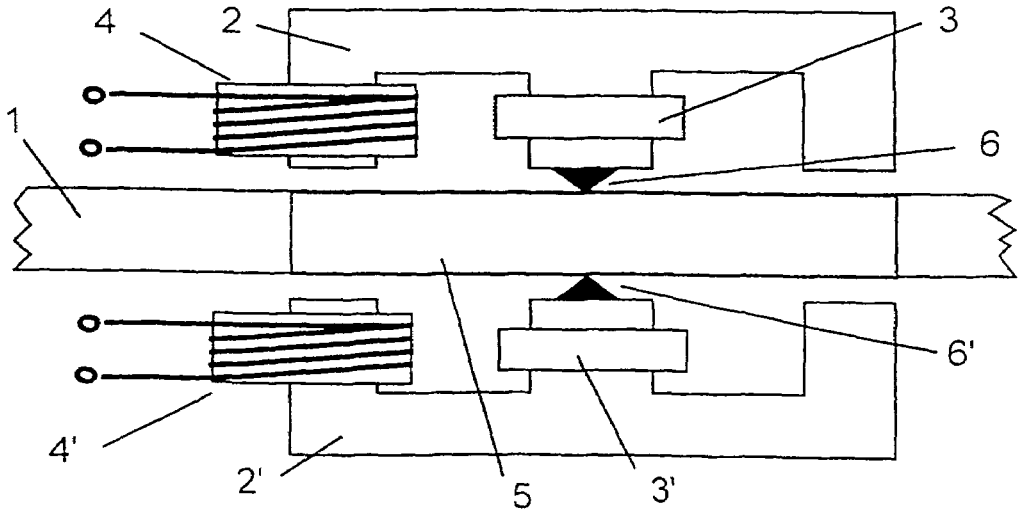
FIG. 4 is a fourth embodiment of a driver according to the invention to be mounted on the edge of the planar diaphragm loudspeaker.

The driver of the invention shown in FIG. 4 has a soft magnetic yoke 5 placed near the edge of a sound plate 1. Also provided are an E-shaped pole core 2, 2', a fixed magnetic coil 4, 4' through which the signal current flows, and a permanent magnet 3, 3' inserted into the central leg of the E-shaped pole core 2, 2'. The latter is supported by a (toe- or a) knife-edge bearing 6, 6' on the pole core 2, 2', so that said yoke 5, 5' can pivot around a fixed point (knife-edge bearing 6, 6') as a result of a magnetically generated torque. A torque driver of this type can be located anywhere on the surface of the sound plate 1. The just described arrangement is preferably duplicated. This duplicated arrangement acts on the sound plate 1 by using another magnetic coil 4', another pole core 2' and another permanent magnet 3' as a mirror image from the opposite side. In the form shown in FIG. 4 the pivot movement due to the knife-edge bearing 6, 6' is not optimum.

Figure 5A:
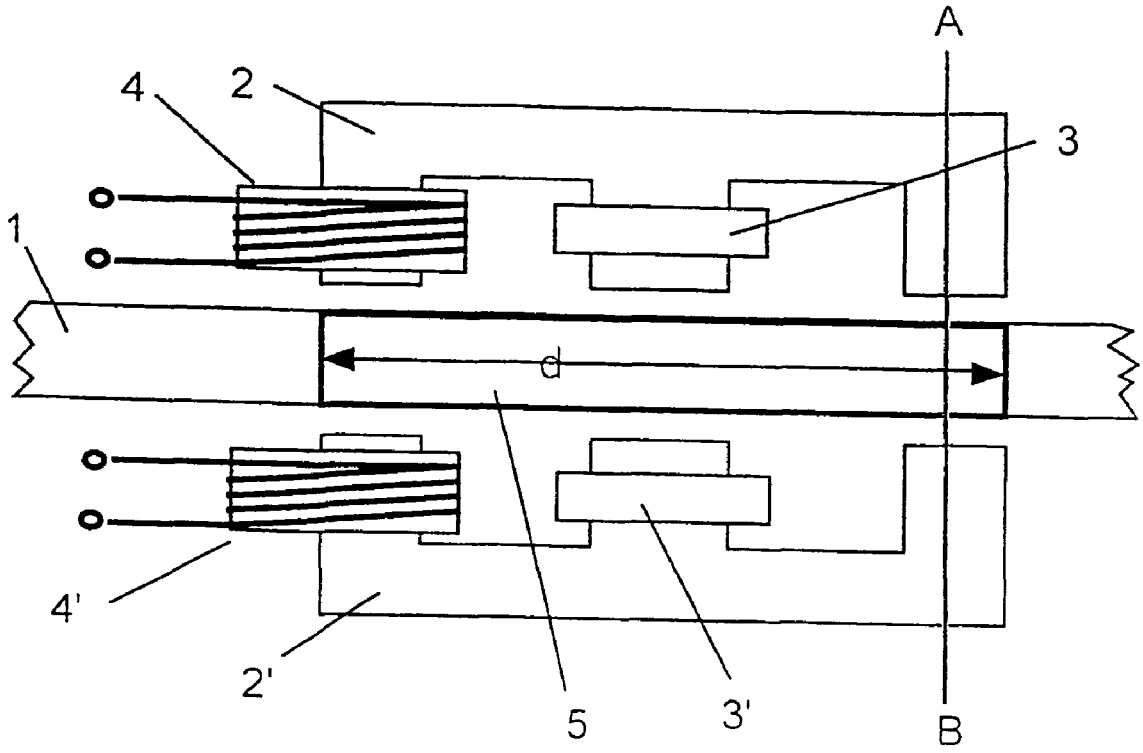
FIG. 5 is a fifth embodiment of a driver according to the invention to be mounted on the edge of the planar diaphragm loudspeaker.
Figure 5B:
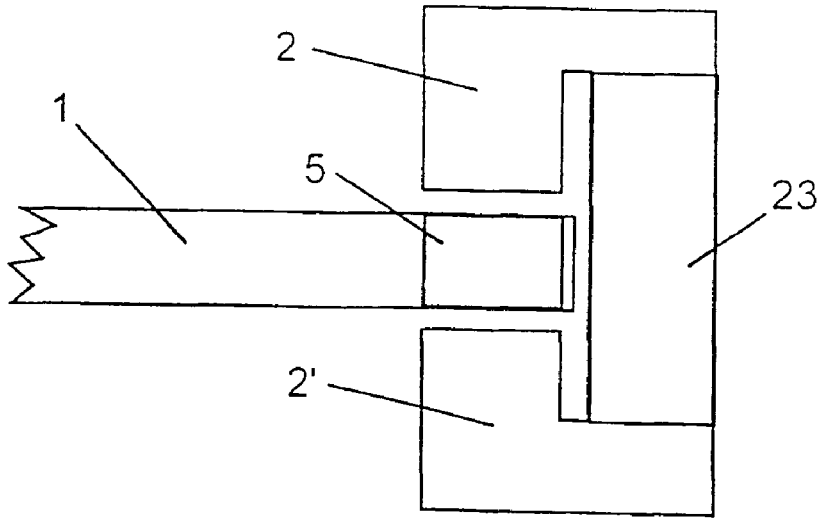

By contrast the embodiment shown in FIG. 5 is an improvement, which only differs because of the missing knife-edge bearing 6, 6'. In the embodiment of FIG. 5 the missing support (knife-edge bearing 6, 6') is replaced by a rigid backside connection (support 23) which cannot be seen in FIG. 5*a*, but can be seen in the A–B cut of FIG. 5*b*.

Again a clamplike construction of the driver according to the invention can be seen. The two pole cores 2 and 2' are securely connected by a rigid support 23 outside the edge area of the plate. The sound plate 1 with the inserted soft magnetic yoke 5 "floats" in the center without touching the slightly opened clamp. The sound plate 1 must be held in this position (for example by the nonmagnetic spring element 7), but this can also be achieved independently of the driver.

Three force effects can essentially be imagined with an electromagnetic driver without a conductor through which current flows in the pole field. The force on the parts magnetized to saturation in the homogeneous field, the force on soft magnetic parts in the homogeneous field, and the force on soft magnetic parts in the nonhomogeneous field. The first two effects were already mentioned earlier, while the third effect, in which the force is proportional to the field gradient, is completely eliminated in this case. In a good approximation the field between the upper and the lower E-shaped pole core 2, 2' is homogeneous. Since the yoke 5 is not magnetized in the embodiment shown in FIG. 5, the force on soft magnetic parts remains decisively in the homogeneous field.

If we first consider only one half of the mirror image construction of the driver (the upper half in FIG. 5), the following results: the central leg of the pole core 2 is highly saturated by the insertion of the permanent magnet 3 and is practically no longer conductive; it can therefore be considered a practical source of constant magnetic flux. This permanent flux is symmetrically and unidirectionally distributed to the two outer legs of E-shaped pole core 2. By contrast the signal flux originated by the magnetic coil 4 flows to the other outer leg without considering the no longer conducting central leg. Thus an addition of the respective inductions B takes place in one outer leg, and a subtraction in the other. The soft magnetic yoke 5 closes all circuits. The results are different attractive forces $F_L$, $F_R$ in the left and right outer leg. For the left outer leg we have:

$$F_L = As(B_s + B_p)^2/\mu$$

where A identifies the pole surface and s the gap size. For the right outer leg we respectively have:

$$F_R = As(B_s - B_p)^2/\mu$$

Accordingly a torque M is produced in the yoke 5, which can be described as follows:

$$M = (F_L - F_R)d/2 = 2AsdB_sB_p/\mu,$$

where d represents the yoke length and therefore the dipole gap. The torque M is linearly proportional to induction $B_s$ and thus to the signal current I. A prerequisite therefore is the support by the pivot bearing (knife-edge bearing 6) and a resulting lever effect. Without the pivot bearing (knife-edge bearing 6) as the support, the cumulative force would also become active and be a quadratic function of the signal current.

As shown in FIGS. 4 and 5, a clamp construction on the edge can replace the support on the pole core by means of a reciprocal rearward support of both E-shaped pole cores. For the support with torque formation, the polarity of the individual coils and permanent magnets must be chosen so that the cumulative force is created in one outer leg and the differential force in the other, where the mirror image E-shaped pole core is polarized in precisely the opposite direction. This means that the cumulative force in the outer leg of an E-shaped pole core 2 forms a differential force in the corresponding outer leg of the other E-shaped pole core 2', and vice versa. No torque is created if the wrong polarity is selected, but a correct polarity selection creates a double torque.

It is advisable with the drivers of the invention to fill the vibration gap in the pole area of the permanent magnets of the drivers with flexible pads, which interfere very little with the vibrations but are able to absorb the static weight of the sound plate. The more drivers are installed on the edge, the softer the pads can be designed. These pads were not illustrated in the figures for the sake of clarity.

A general problem in multiresonance planar diaphragm loudspeakers is the tuning of the sound plate to provide the desired broadband progression to the acoustic radiation frequency. This tuning has usually some success with the skillful placement and sensitivity adjustment of the drivers distributed on the sound plate. However the more drivers are used the harder the tuning becomes. The mass load creates new and more serious mistuning. But the drivers of the invention provide the possibility of sound plate tuning without any mass load.

Three significant adjustable parameters can be used for the active plate tuning of additional drivers of the invention through which signal current flows: the dipole gap d, the sensitivity and the position along the edge. The dipole gap can be used to address targeted vibration modes of suitable bending wave lengths. A placement choice along the edge increases the desired accuracy. Adjusting the sensitivity properly tailors the effect of this active electronic plate tuning. In addition a suitable adjustment of the just mentioned parameters can accomplish the desired tuning of sound plates used for signalling purposes where the drivers are only installed on the edge.

Table 1 is a list of reference symbols as used herein and in the drawings.

TABLE 1

| List of reference signs | |
|---|---|
| 1, 1' | Plate |
| 2, 2' | Pole core |
| 3, 3' | Permanent magnet |
| 4, 4' | Coil |
| 5, 5' | Soft magnetic yoke |
| 6, 6' | Knife-edge bearing |
| 7, 7' | Nonmagnetic spring element |
| 8, 8' | Central leg of the pole core |
| 9, 9' | Magnetic alternating field vector |
| 10, 10' | Magnetic constant field vector |
| 17, 17' | Magnetic coil |
| 18, 18' | Pole core |
| 19, 19' | Permanent magnet |
| 20 | Knife-edge bearing |
| 21 | Plate |
| 22 | Yoke |
| 23 | Support |
| I | Sonic frequency alternating current |
| N | North pole |
| S | South pole |
| d | Yoke length |

The invention claimed is:

1. An electromagnetic driver for a planar diaphragm loudspeaker, with a soft magnetic core (2) in an E-shaped form having three legs and a back;

an alternating field exciter (4) that is magnetically coupled to the soft magnetic core (2), for generating a magnetic alternating flux that depends on a sound signal (I), in the soft magnetic core (2);

a constant field exciter (3) which is magnetically coupled to the soft magnetic core (2), for generating a constant magnetic flux in the soft magnetic core (2); and a soft magnetic element (5), which magnetically terminates the legs with at least one small induction gap and is located opposite the back, for coupling with the plate (1) of the planar diaphragm loudspeaker, where the alternating flux and the constant flux are asymmetrically superimposed so that a resulting force or a resulting torque in the soft magnetic element (5) is essentially linear with respect to the sound signal (I).

2. An electromagnetic driver as claimed in claim 1, wherein a yoke (5) is provided as the soft magnetic element, which can pivot on the free end of the central leg of the soft magnetic core (2), and has induction gaps at least with respect to the other two legs of the soft magnetic core (2), so that the yoke (5) which is driven by the alternating field exciter (4) generates a corresponding torque.

3. An electromagnetic driver as claimed in claim 2, wherein the alternating field exciter is a coil (4) which is controlled by the sound signal (I) and is located on one or both of the outer legs of the soft magnetic core (2).

4. An electromagnetic driver as claimed in claim 3, wherein a permanent magnet (3) is provided as the constant field exciter, and is installed on the central leg of the soft magnetic core (2).

5. An electromagnetic driver as claimed in claim 3, wherein a coil through which a direct current flows is provided as the constant field exciter, and is installed on the central leg of the soft magnetic core (2).

6. An electromagnetic driver as claimed in claim 5, wherein the yoke (5) is kept in the resting position by two nonmagnetic spring elements (7) located in the induction gaps between the outer legs of the soft magnetic core (2) and the yoke (5).

7. An electromagnetic driver as claimed in claim 6, wherein a nonmagnetic bearing (6) is provided to set the yoke (5) on the central leg of the soft magnetic core (2).

8. An electromagnetic driver for a planar diaphragm loudspeaker with two soft magnetic cores (2, 2') each having an E-shaped form with three legs and a back, which are secured back-to-back;

two alternating field exciters (4, 4') which are magnetically coupled to each of the soft magnetic cores (2, 2'), for generating a magnetic alternating flux that depends on a sound signal (I), in the respective soft magnetic core (2, 2');

two constant field exciters (3, 3') which are magnetically coupled to each of the soft magnetic cores (2, 2') for generating a constant magnetic flux in the respective soft magnetic core (2, 2'); and two soft magnetic elements (5, 5') which magnetically terminate the respective legs with at least one small induction gap and are located opposite the respective back, for coupling with the plates (1, 1') of the planar diaphragm loudspeaker, where the alternating flux and the constant flux are asymmetrically superimposed so that a resulting torque in the respective soft magnetic element (5, 5') is essentially linear with respect to sound signal (I).

9. An electromagnetic driver for a planar diaphragm loudspeaker with a soft magnetic core (2, 2') in the form of two partial E-shapes (2, 2') having three legs each, which are secured back-to-back;

two alternating field exciters (4, 4') which are magnetically coupled to each of the partial E-shaped forms (2, 2'), for generating in the respective soft magnetic core (2, 2') a magnetic alternating flux that depends on a sound signal (I);

two constant field exciters (3, 3') which are magnetically coupled to each of the E-shaped partial forms (2, 2'), for generating a constant magnetic flux in the respective soft magnetic core (2, 2'); and two soft magnetic elements (5, 5') which magnetically terminate the legs of the respective partial E-shaped forms by means of at least one induction gap and are located opposite the respective back, for coupling with the plates (1, 1') of the planar diaphragm loudspeaker, where the alternating flux and the constant flux are asymmetrically superimposed so that a resulting torque in the respective soft magnetic element(s) (5, 5') is essentially linear with respect to sound signal (I).

10. An electromagnetic driver for a planar diaphragm loudspeaker with a soft magnetic core (2) in an E-shaped form having three legs and a back, which is arranged on the edge of the plate (1) so that the latter is located on the side opposite the back and its two outer legs are bent clamplike toward the plate (1);

an alternating field exciter (4) that is magnetically coupled to the soft magnetic core (2), for generating in the soft magnetic core (2) a magnetic alternating flux that depends on a sound signal (I); and a constant field exciter (3) which is magnetically coupled to the soft magnetic core (2) and is located in the plate (1) in the area of the open leg ends, for generating a constant magnetic flux in the soft magnetic core (2), where the alternating flux and the constant flux are asymmetrically superimposed so that a resulting force acting on the constant field exciter (3) is essentially linear with respect to the sound signal (I).

11. An electromagnetic driver as claimed in claim 10, wherein a fixed coil (4) is provided as the alternating field exciter on the central leg and is controlled by the sound signal (I), and a permanent magnet (3) is the constant field exciter, where the outer legs of the soft magnetic core (2) detect a constant magnetic flux from the permanent magnet (3) flowing parallel to the normal plate direction, and an alternating flux emitted from the central leg of the soft magnetic core (2), so that the alternating flux and the constant flux are added in one of the outer legs of the soft magnetic core (2), and are subtracted in the other outer leg of the soft magnetic core (2).

12. An electromagnetic driver as claimed in claim 11, in which nonmagnetic spring elements (7) are located between the outer legs of the soft magnetic core (2) and the plate (1).

13. An electromagnetic driver as claimed in claim 12, which is arranged so that the forces it generates affect an edge area of the plate (1), where the width of the edge area is approximately the same as the thickness of the plate (1).

14. An electromagnetic driver as claimed in claim 1, wherein the alternating field exciter is a coil (4) which is controlled by the sound signal (I) and is located on one or both of the outer legs of the soft magnetic core (2).

15. An electromagnetic driver as claimed in claim 1, wherein a permanent magnet (3) is provided as the constant field exciter, and is installed on the central leg of the soft magnetic core (2).

16. An electromagnetic driver as claimed in claim 1, wherein a coil through which a direct current flows is provided as the constant field exciter, and is installed on the central leg of the soft magnetic core (2).

17. An electromagnetic driver as claimed in claim 1, wherein the yoke (5) is kept in the resting position by two nonmagnetic spring elements (7) located in the induction gaps between the outer legs of the soft magnetic core (2) and the yoke (5).

18. An electromagnetic driver as claimed in claim 1, wherein a nonmagnetic bearing (6) is provided to set the yoke (5) on the central leg of the soft magnetic core (2).

19. An electromagnetic driver as claimed in claim 10, in which nonmagnetic spring elements (7) are located between the outer legs of the soft magnetic core (2) and the plate (1).

20. An electromagnetic driver as claimed in claim 1, which is arranged so that the forces it generates affect an edge area of the plate (1), where the width of the edge area is approximately the same as the thickness of the plate (1).

* * * * *